United States Patent [19]

Knudsen et al.

[11] Patent Number: 4,526,562

[45] Date of Patent: Jul. 2, 1985

[54] MACHINE AND PROCESS FOR PRODUCING INSERTS HAVING FOLDED PULL TABS

[76] Inventors: David S. Knudsen; James D. Knudsen, both of 3145 Hawthorne Blvd., St. Louis, Mo. 63104

[21] Appl. No.: 365,338

[22] Filed: Apr. 5, 1982

[51] Int. Cl.[3] ..... B31B 1/90

[52] U.S. Cl. ..... 493/80; 493/76; 493/87; 493/353; 493/357

[58] Field of Search ..... 493/76, 75, 79, 80, 493/87, 353, 357, 356; 413/62, 67, 8

[56] References Cited

U.S. PATENT DOCUMENTS

| | | | |
|---|---|---|---|
| 619,259 | 2/1899 | Morfoot | 413/67 |
| 2,901,994 | 9/1959 | Wheeler | 413/67 |
| 3,734,044 | 5/1973 | Asmus et al. | 113/121 C |
| 3,961,566 | 6/1976 | Westphal et al. | 493/76 |
| 4,155,439 | 5/1979 | Fletcher et al. | 198/339 |
| 4,230,028 | 10/1980 | Knudsen | 493/76 |

*Primary Examiner*—James F. Coan

*Attorney, Agent, or Firm*—Gravely, Lieder & Woodruff

[57] ABSTRACT

A machine for installing a foil insert in a container lid such that the insert may be subsequently sealed to the mouth of a container after the lid is placed on the container includes a punch for blanking an insert from foil sheet, and a plunger having a head that emerges from the punch and carries the blanked insert forwardly to the lid. As the plunger advances, a folding arm presses against the tab and folds it over onto remaining or disc portion of the insert, and while the arm folds the tab, retaining fingers of a holding element hold the insert against the plunger head on each side of the tab to ensure that the tab folds at the proper location. Only after the tab is folded over does the plunger deposit the insert in a lid that is supported in the path of the plunger on a lid holder.

18 Claims, 16 Drawing Figures

FIG. 6
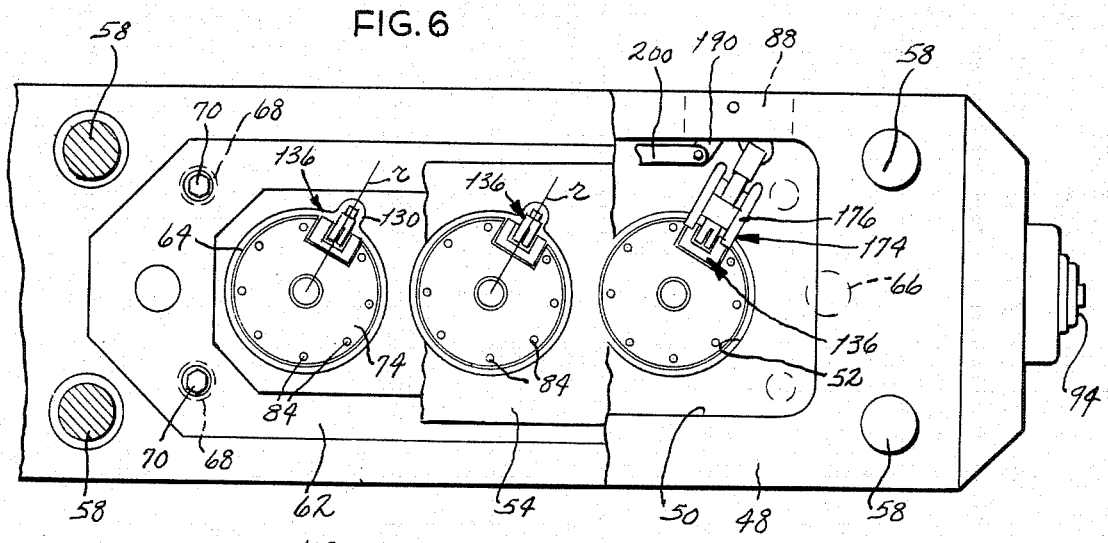
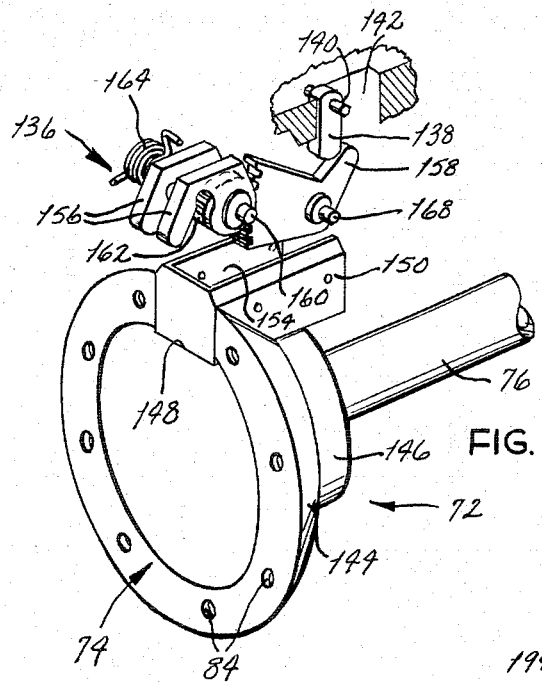
FIG. 8
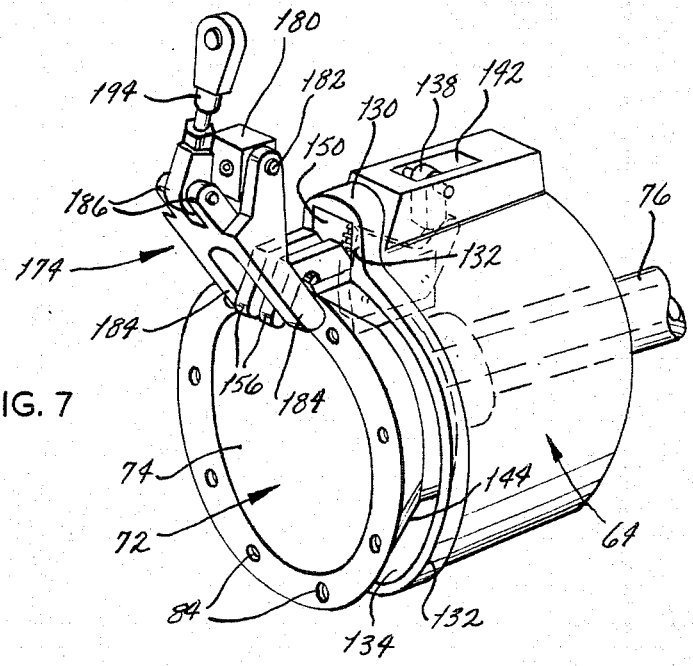
FIG. 7

MACHINE AND PROCESS FOR PRODUCING INSERTS HAVING FOLDED PULL TABS

BACKGROUND OF THE INVENTION

This invention relates to sealing containers, and more particularly to a machine and process for providing inserts having folded pull tabs.

In packaging foods in containers such as jars, bottles and tubs, it is important to form an impervious seal over the mouth of the container so that the contents of the container will not be contaminated during handling and storage. One very effective procedure for sealing such food containers, particularly containers having large mouths, utilizes foil that is heat sealed to the container rims. More particularly, the foil inserts are normally die cut from a large sheet of metal foil which has been coated with a heat sensitive adhesive. Each insert is installed in a lid that is formed from a polymer and is capable of fitting over and interlocking with the rim of a container. Thus, the lid places the insert directly over the container mouth. Thereafter the insert is heated sufficiently to render its adhesive coating pliable, and at the same time the lid is forced downwardly so that the foil insert is compressed tightly against the container rim. As the foil insert cools, the adhesive solidifies and thus bonds the insert to the rim. One highly effective procedure for heating the insert is to pass it through a rapidly oscillating magnetic field, and a machine for heating in this manner is disclosed in U.S. Pat. No. 4,095,390.

The lid into which the insert is installed prior to placement over the container mouth serves as a convenient carrier for the insert which by itself would be extremely difficult to handle, particularly during a heat sealing operation. Thus, the lid facilitates the actual placement of the insert over the container mouth and the inductive heat sealing of that insert to the container mouth. The lid further protects the somewhat fragile insert during handling and storage of the container, and once the insert is removed or ruptured to gain access to the contents of the container, the lid thereafter functions as a convenient closure for the container.

U.S. Pat. No. 4,230,028 discloses a machine for die cutting foil inserts from sheet foil and for installing those inserts in container lids on a rapid and highly automated basis. However, the machine cuts inserts that correspond in configuration to that of the lid and container rim. It does not have the capability of installing inserts provided with pull tabs. In this regard, some food packager prefer to have pull tabs on the inserts of their containers, so that once the lid is removed, the inserts can be peeled off of the container rim by grasping it at its pull tab and pulling upwardly.

SUMMARY OF THE INVENTION

One of the principal objects of the present invention is to provide a machine for cutting from a flexible sheet material inserts having outwardly directed tabs and for folding the tabs of those inserts over onto the remaining or disc portions of the inserts. Another object is to provide a machine of the type stated which further installs the inserts with the folded tabs within container lids. A further object is to provide a machine of the type stated that is an adaptation of the machine of U.S. Pat. No. 4,230,028 and renders that machine suitable for installing tabbed inserts. An additional object is to provide a machine of the type stated which ensures that the tab folds at the proper location along the insert. Still another object is to provide a process for blanking tabbed inserts, folding the tabs over onto the remaining or disc portions of their respective inserts, and depositing the inserts with the folded tabs in container lids. These and other objects and advantages will become apparent hereinafter.

The present invention is embodied in a machine having lid carrying means, insert carrying means for supporting a tabbed insert, means for imparting movement to one of the carrying means to bring the carrying means together, and means for folding the tab of the insert over onto the remaining portions of the insert while the insert is supported on the insert carrying means. The invention is also embodied in a machine having a die, a punch aligned with an opening in the die, means for moving the punch into and out of the die opening, means for positioning flexible sheet material between the punch and die so that a tabbed insert is blanked from the sheet, a plunger supported on the punch and being capable of moving away from the punch and carrying an insert blanked by the punch with it, and means carried by the plunger for folding the tab of the blanked insert forwardly and over onto the remaining portion of the insert. The invention is further embodied in a process that includes blanking an insert having a tab on it, folding the tab of the insert, gripping the insert on each side of its tab while the tab is folded, and thereafter depositing the insert in a lid. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur -

FIG. 6 is an elevational view of the machine taken along line 6—6 of FIG. 2 and showing the die shoe broken away to expose the die plate, the pressure plate, the punches, and the punch plate which are located behind the die shoe;

FIG. 7 is a perspective view of a punch and plunger as well as the tab folding mechanism of the plunger and the holding mechanism that cooperates with it, all illustrated with the plunger partially extended from the punch;

FIG. 8 is a persepctive view of a plunger and its tab folding mechanism;

DETAILED DESCRIPTION

Figure 1:
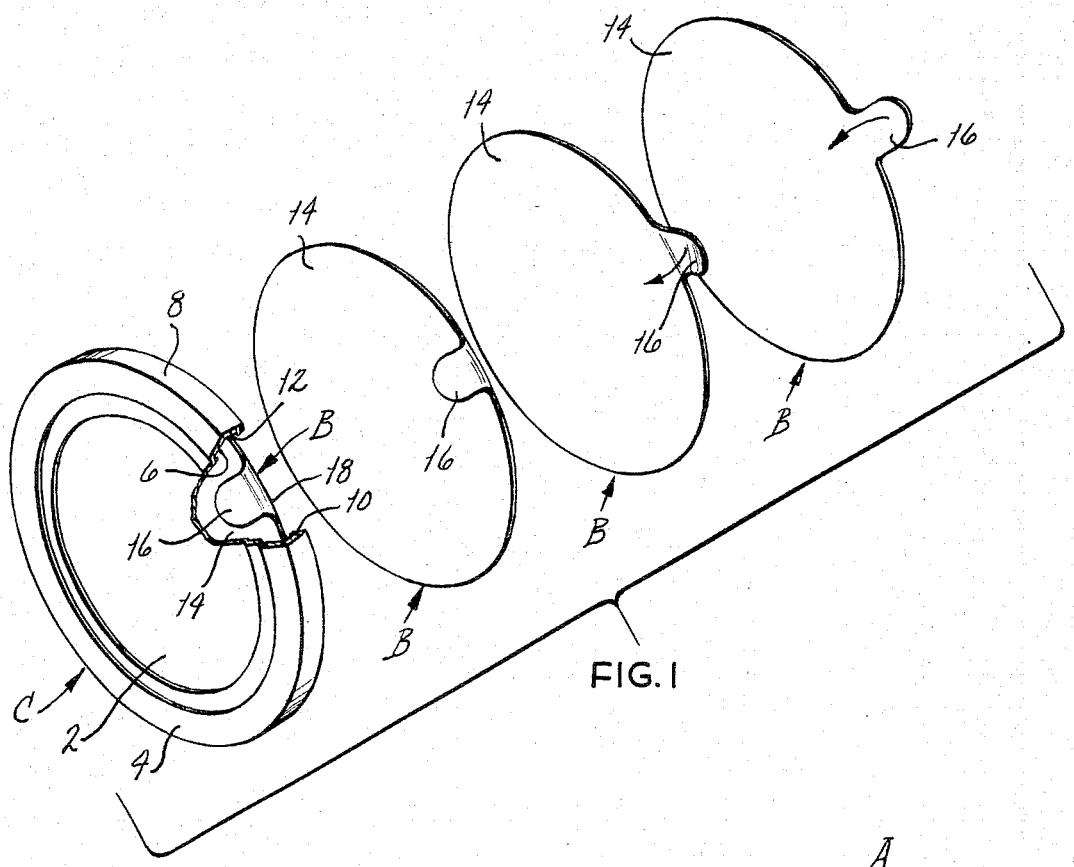
FIG. 1 is a perspective view showing a tabbed insert die cut in the machine of the present invention, with the insert being illustrated sequentially as its tab is folded from a fully extended position to a folded position, and also showing the lid into which the insert is installed by the machine.

Referring now to the drawings, a machine A (FIGS. 2, 3 & 5) die cuts inserts B (FIG. 1) from a foil sheet s and installs each insert in a lid C which is configured to fit over and engage the rim of a container (not shown), such as a jar, a bottle, or a tub. Moreover, the foil insert B is adapted to be sealed to the rim of the container so to produce an impervious barrier over the mouth of the container. The lid C serves as a convenient carrier for the highly flexible insert B, and once the lid and insert are in place over the container mouth the lid protects the insert B from being punctured during subsequent handling and storage.

Considering the lid C first, it is normally circular, but can be other configurations as well. It is molded from a flexible polymer which facilitates its installation on and removal from the rim of a container. The lid C includes (FIG. 1) a closure portion 2 which is large enough to close the mouth of the container. For the most part the closure portion 2 is flat, but at its periphery the portion 2 is provided with a depression 6 that is essentially the same diameter as the container rim and has a flat and uninterrupted base surface. In addition, the lid C has a circular flange 8 which is attached to the closure portion adjacent to the depression 6 and projects axially in the direction that the depression 6 opens. The flange 8 on its inwardly presented face has a beveled surface 10 that leads up to a groove 12 which opens radially toward the center of the lid C. The flange 8 is just large enough to fit snugly over the rim of the container and engage that rim generally at the smallest diameter of beveled surface 10.

The insert B is formed from a thin foil of a suitable metal, such as aluminum, and is coated on one of its surfaces with a heat-activated adhesive, which may be merely a very thin polymer coating. The other surface remains uncoated. The insert B includes (FIG. 1) a main or disc portion 14 which essentially possesses the same configuration as the center portion 2 of the lid C, but is perhaps slightly larger so that when the insert B is fitted into the lid C from the direction in which the flange 8 projects, the peripheral edge of the main portion 14 will extend into groove 12 of the lid flange 8. In most instances the main portion 14 will be circular, its diameter being only slightly greater than the diameter of the center portion 2 on the circular lid C. In addition, the insert B includes a pull tab 16 which is attached to the main portion 14 along the periphery of the latter. The insert B is die cut within the machine A with the pull tab 16 projecting laterally from the main portion 14. However, before the machine A installs the insert B within the lid C, it folds the tab 16 over along a fold line 18 that corresponds with and forms a continuation of the periphery for the main portion 14. Indeed, the machine A folds the tab 16 completely against the outwardly presented or uncoated surface of the main portion 14. Thus, with the tab 16 folded over, the insert B possesses a circular configuration and fits snugly into the groove 12 in the flange 8 of the lid C. When so disposed the tab 16 and most of the main portion 14 for the insert B are against the closure portion 2 of the lid C.

The machine A is to a large measure very similar to the machine of U.S. Pat. No. 4,230,028 in that it has a table 22 (FIGS. 3 & 5) which indexes about a vertical axis of rotation and along its periphery has lid holders 24 that are capable of holding the lids C in an upright position with their flanges 8 projected away from the axis of rotation for the table 22. The table 22 moves the lid holders 24 past various stations where, among other operations, lids C are loaded into the holders 24, the inserts B are blanked from sheet foil s and installed within the lids C that are in the holders 24, the foil inserts B are seated securely within the lids C, and the lids C with the inserts B seated firmly within them are discharged where they may be used in a capping and sealing machine of the type described in U.S. Pat. No. 4,095,390.

Each holder 24 includes (FIGS. 3 & 4) a backing block 30 that is mounted firmly upon the indexing table 22 and has a flat surface that is presented outwardly. The flat surface is divided into three different areas or pockets 32 by guide bars 34, and each pocket 32 is wide enough to lossely receive a single lid C. The pockets 32 are completely open at their upper ends, so that the lids C may be lowered with ease into them, but their lower ends are obstructed by positioning pins 36. Indeed, the lids C for any pocket 32 will rest upon the pins 36 at that pocket 32 and assume a precise position within the pocket 32. The pins 36 project from the block 30 and are capable of being retracted into the block 30 to release the lids C from their respective pockets 32. The guide bars 34 further serve as mouths for a retaining plate 38 which prevents the lids C from falling forwardly out of the pockets 32. At each pocket 32, the retaining plate 38 is provided with a circular aperture 40 that is slightly smaller in diameter than the flanges 8 on the lids C, and these apertures 40 are positioned such that when the lids C are resting on their respective positioning pins 36, each aperture 40 is concentric with the lid C immediately behind it. Thus, the center portions 2 of the lids C are exposed through the apertures 40.

The major difference between the machine A and the machine of U.S. Pat. No. 4,230,028 exists at the station where the machine A blanks the inserts B from the foil sheet s, and loads them onto the container lids C, this station being known as the inserting station. Unlike the machine of U.S. Pat. No. 4,230,028, the machine A is equipped to blank the inserts B with the tabs 16 and to further fold the tabs 16 against the uncoated faces of the inserts B before installing the inserts B in lids C that are in the holder 24 which is at the inserting station. Hence, only the inserting station of the machine A will be described in detail.

At its inserting station the machine A has a rigid frame 46 (FIGS. 3 & 5) on which a die shoe 48 is mounted. The die shoe 48 has a large recess 50 (FIGS. 2 & 6) which opens forwardly toward the lid holder 24 that is at the inserting station, and further has three apertures 52 that open into the recess 50. The apertures 52 are primarily circular in configuration, each being slightly larger in diameter than the main portions 14 of the inserts B, and align with the apertures 40 in the retaining plate 38 for the lid holder 24 that is at the inserting station. Bolted to the back face of the die shoe 48 is a die plate 54 having openings 56 that are located behind and are of the same general configuration as the apertures 52 in the die shoe 48. Actually, the openings 56 in the die plate 54 have precisely the same configuration as the inserts B when they are in the unfolded condition, and indeed the inserts B are blanked through them. In this regard, the portion of each opening 106 at which the tab 16 for the insert B is formed is presented generally upwardly, but nevertheless also slightly to the side such that a radius centered on the tab-forming portion is offset about 30° from the vertical.

Figure 3:
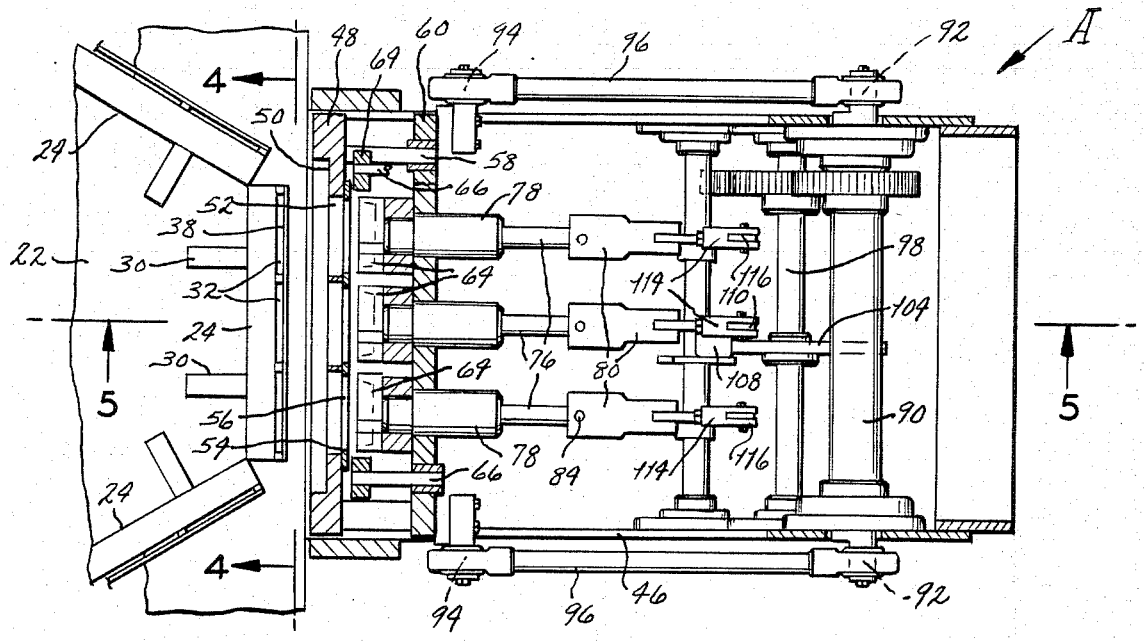
FIG. 3 is a sectional view of the machine taken along line 3—3 of FIG. 2 and showing the lid holder in addition to the components of the inserting station.
Figure 4:
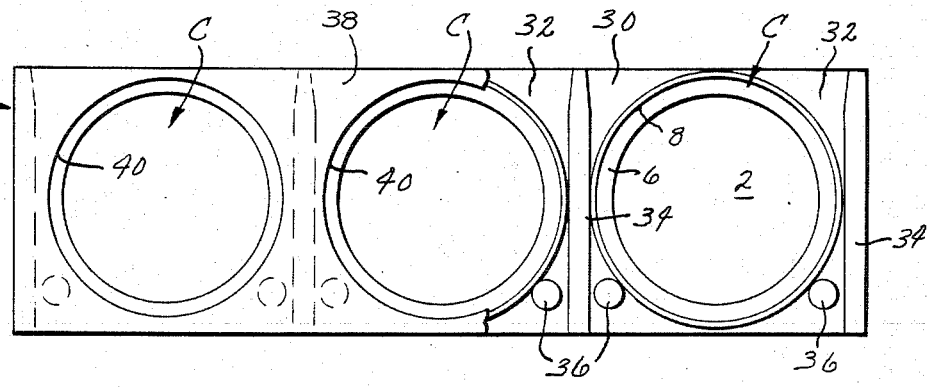
FIG. 4 is a sectional view of the machine taken along line 4—4 of FIG. 3 and showing the lid holder with a portion of its retaining plate broken away to expose the guide bars and backing block located behind it.

Projecting rearwardly from the die shoe 48 are leader pins 58 (FIGS. 3 & 6), which serve as guideways for a punch plate 60 that moves toward and away from the die shoe 48 on the pins 58. The punch plate 60, in turn, carries a pressure plate 62 and three punches 64. The pressure plate 62 has smaller leader pins 66 projected from it into the punch plate 60 so that the pressure plate 62 can shift horizontally with respect to the punch plate 60. However, the pressure plate 62 is urged away from the punch plate 60 by compression springs 68 (FIG. 6), yet is restrained by shoulder bolts 70 which, when the pressure plate 62 is otherwise unrestrained, position the pressure plate 62 only slightly ahead of the leading edges on the punches 64 (FIG. 3). Moreover, the pressure plate 62 has apertures which are large enough to accommodate the punches 64 so that the punches 64 can move through the pressure plate 62. When the punch plate 60 is in its rearmost position, the pressure plate 62 is located slightly rearwardly from the die plate 54, providing a space through which the foil sheet s passes. However, as the punch plate 60 moves forwardly, the pressure plate 62 will press the foil sheet s against the back face of the die plate 54 and clamp the sheet s tightly in the region surrounding the die openings 56.

The punches 64, in contrast to the pressure plate 62, are mounted firmly upon the punch plate 54 and are configured from a peripheral standpoint to correspond to the openings 56 in the die plate 54 (FIGS. 3 & 6). Indeed, each punch 64 aligns with a separate die opening 56 and will enter that die opening 56 during the forward movement of punch plate 60. This occurs after the pressure plate 62 has clamped the foil sheet s firmly against the back face of the die plate 54, so that the punches 64 upon passing through the pressure plate 62 and into the openings 56 blank inserts B from the foil sheet s without carrying the remaining portion of the foil sheet s forwardly into the openings 56. In this manner the inserts B are die cut from the foil sheet s.

The punches 64 carry the inserts B which are blanked by them only a slight distance into the die plate 56, but each punch 64 contains a plunger 72 (FIG. 5) which extends out of it and carries the insert B that is blanked by its punch 64 all the way forwardly to the lid C that is aligned with it in the lid holder 24 at the inserting station. More specifically, each punch 64 has a continuous periphery that corresponds in contour to the die opening 56 immediately ahead of it, but within the confines of that periphery it is provided with a generally circular cavity in which the plunger head 74 is housed, at least when the punch plate 60 is in its rearmost position (FIG. 7). The head 74 forms part of the plunger 72 and its front face, which is flat, is set slightly rearwardly from the leading or cutting edge of the punch 64 when the plunger 72 and punch 64 are in their fully retracted, that is rearmost, positions. In addition, the plunger 72 includes a push rod 76 (FIGS. 3 & 5) that is connected to the head 74 and extends axially rearwardly therefrom, it being confined radially by a bushing 78 that is fitted firmly to the punch plate 60 and projects rearwardly from it. At its end, the push rod 76 is fitted with an adapter 80 that contains a buffer spring 82 which enables the adapter 80 to move slightly forwardly after the plunger head 74 bottoms out. Finally, the head 74 of the plunger 72 near its periphery is provided with ports 84 (FIGS. 5 & 6) that open out of its flat front face, and these ports communicate with a bore 86 that extends through the interior push rod 76 and at the end of the push rod 76 opens into a flexible vacuum line 88. Thus, once the head 74 of the plunger 72 emerges from the punch 64, the insert B which is blanked out by the punch 64, is held against the flat face of the head 74 by the pressure of atmospheric air. The insert B remains against the head 74 as the head 74 travels forwardly to the lid C in the lid holder 24 that is at the inserting station.

Movement is imparted to the punch plate 60, and likewise to the punches 64 on it by a single shaft 90 (FIGS. 3 & 5) which extends completely across the frame 46 and at its ends is provided with eccentric journals 92. The punch plate 60, on the other hand, has journals 94 projecting laterally beyond its ends, and the journals 92 and 94 at each side of the frame 46 are connected together by drive rods 96. Thus, as the shaft 90 rotates, the punch plate 60 moves forwardly and rearwardly. On the forward movement, it forces the pressure plate 62 tightly against the foil sheet s, thereby clamping the sheet s against the back of the die plate 54. Thereafter the advancing punch plate 60 drives the punches 64 into the foil sheet s and likewise into the opening 56 of the die plate 54. As a result, inserts B are blanked from the foil sheet s. On the rearward movement for the punch plate 64, the punches 64 first withdraw from the openings 56 in the die plate 54 and then the pressure plate 62 retracts from the die plate 54, so as to free the foil sheet s.

The movement for the plunger 72, on the other hand, is imparted by two additional shafts 98 and 100 (FIGS. 3 & 5) which are connected to the shaft 90 through a gear train 102 such that all three shafts 90, 98, and 100 rotate at the same velocity. The shaft 98 has a cam 104 on it, whereas the shaft 100 has another cam 106 of different shape on it. The two cams 104 and 106 contact roller followers 108 on an actuating arm 110 that is mounted on and rotates with a cross shaft 112 that extends across the frame 46 ahead of the two shafts 98 and 100. The follower 108 for the cam 104 is above the shaft 112, while the follower 108 for the other cam 106 is below the shaft 112. The arrangement is such that the cam 104 drives the upper end of the arm 110 forwardly, whereas the cam 106 drives it rearwardly. Both cams 104 and 106 remain continuously in contact with their respective roller followers 108, so there is no free motion in the arm 110 or the cross shaft 112 to which it is attached.

At its upper end, the actuating arm 110 is connected to the adapter 80 of the center plunger 72 by means of a short link 114. The adapters 80 of the other two plungers 72 are connected by identical links 114 to operating arms 116 (FIGS. 2 & 3) which are mounted on the cross shaft 112 parallel to actuating arm 110. As a consequence, the other two plungers 72 move in unison with the center plunger 72.

Figure 5:
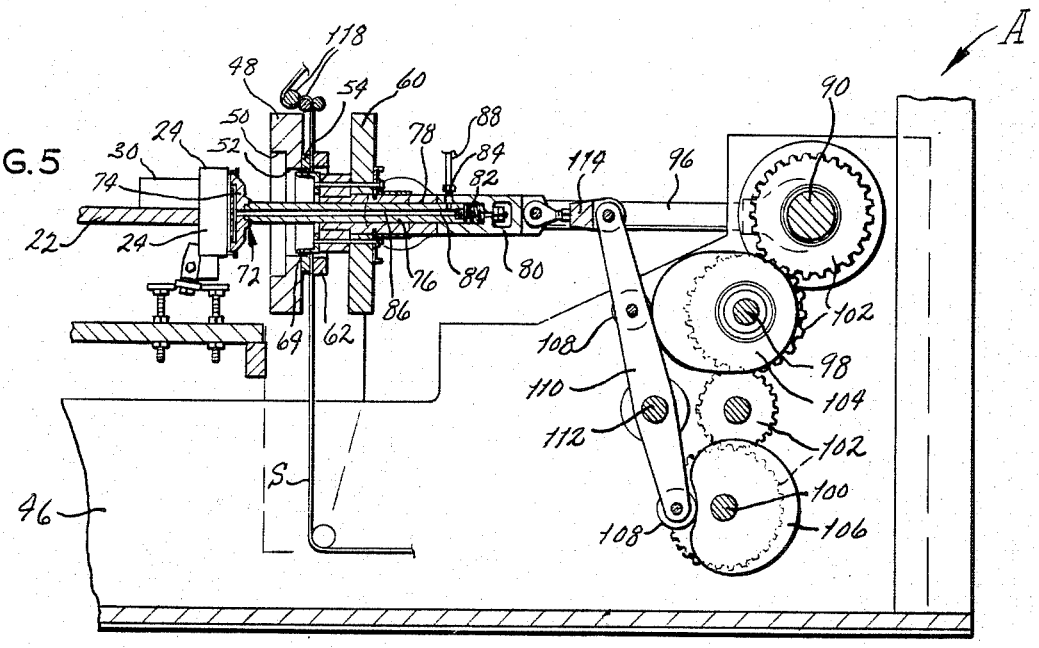
FIG. 5 is a sectional view of the machine taken along line 5—5 of FIG. 3, but showing a punch and its plunger in their fully extended positions.

The cams 104 and 106 are configured such that the punch plate 60 and plungers 72 initially move together out of the rearmost position for both, but once the punches 64 on the plate 60 enter the die opening 56 and blank inserts B from the foil sheet s, the plungers 72 advance more rapidly than the punches 64 and indeed the heads 74 of the plungers 72 move all the way to the lids C in the lid holders 24 at the inserting station (FIG. 5). In so doing, they carry the inserts B forwardly and deposit them in the lids C. The plungers 72 then return at a much more rapid rate than the punches 64, and indeed the plunger heads 74 move into the punches 64 and return to the initial position with the punches 64.

In a typical machine A the eccentric journal 92 and the cams 104 and 106 are configured and arranged to impart the following relative motions to the punches 64 and plunger heads 74, with bottom dead center for the shaft 90, that is the rearmost position for the eccentric journals 92 on the shaft 90, being the reference point:

| Angular position of shaft 90 | Movement of punch 64 | Movement of plunger head 74 |
|---|---|---|
| 0° (BDC)–90° | 9/16" | 9/16" |
| 90°–180° (TDC) | 9/16" | 3⅜" |
| 180°–270° | 9/16" | 3⅜" |
| 270°–360° (BDC) | 9/16" | 9/16" |

The shaft 90 is connected to an electric motor (not shown), the operation of which is synchronized with the movement of the indexing table 22 such that a lid holder 24 containing empty lids C in its pockets 32 will be positioned at the inserting station each time the plunger heads 74 approach their fully extended or forwardmost positions. The foil sheet s is supplied in roll form, and the sheet remaining after the inserts B have been blanked from it is wound upon a take-up roll after passing through drive rolls 118 (FIG. 5). The drive rolls 118 are driven intermittently such that they advance the foil sheet s each time the punches 64 and the plungers 72 return to their retracted positions, that is, when the pressure plate 62 is withdrawn from the back face of the die plate 54.

Figure 11:
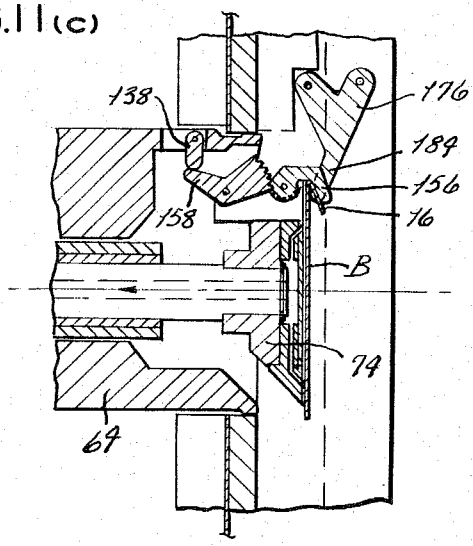
FIGS. 11A-11E are a series of views sequentially showing the plunger as it extends from its punch to deposit an insert in a lid and as it thereafter retracts into the punch, and further showing the condition of the folding mechanism and holding mechanism through the sequence.
Figure 11:
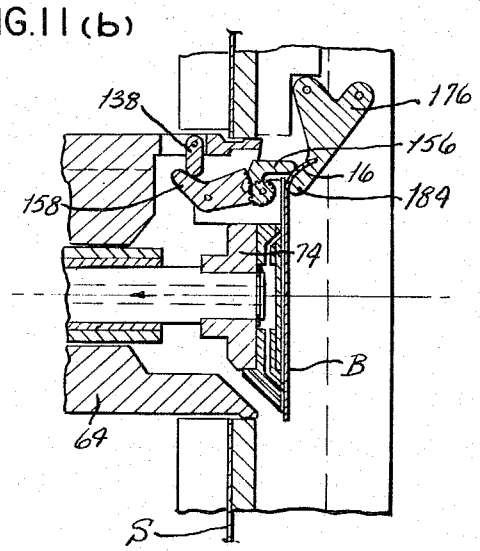
Figure 11:
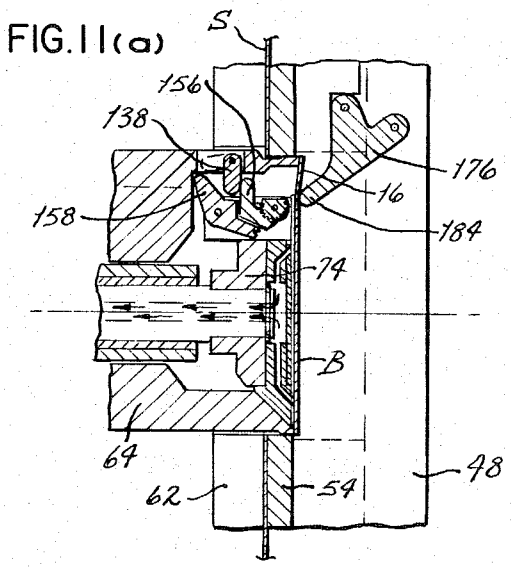
Figure 11:
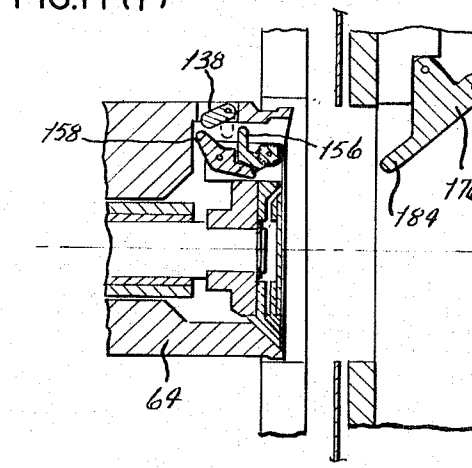
Figure 11:
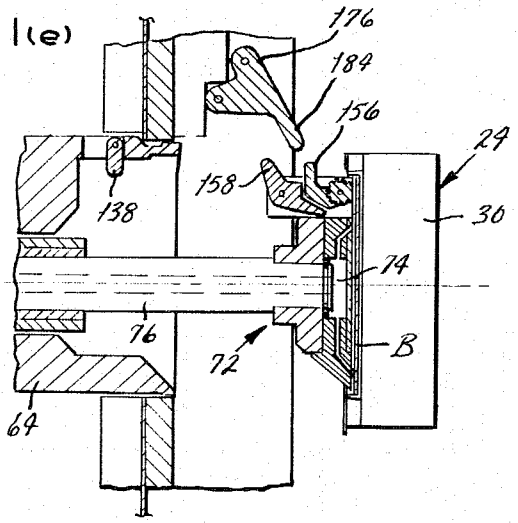
Figure 11:
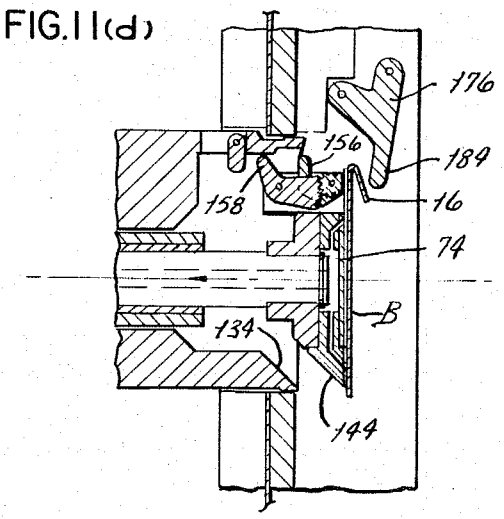

Each punch 64 is continuous along its periphery, and that periphery of course conforms in configuration to the die opening 56 into which it moves (FIG. 6). Thus, the periphery of the punch 64 is circular for the most part, but the circle is disrupted by a protusion 130 which is symetrical about a radius r of the circular portion and corresponds in configuration to the tabs 16 of the inserts B. The punch 64 has a forwardly presented cutting edge 132 (FIG. 7) which along the circular portion of the punch 64 lies in a plane that is perpendicular to the axis of the plunger 72. However, the cutting edge 132 along the protusion 130 is set slightly forwardly from the planar portion of the cutting edge and is also slightly oblique to the remainder of the cutting edge 132 (FIG. 11). Both the circular portion and the protusion 130 of the punch 64 are hollow and along the circular portion, the hollow interior is defined in part by a forwardly presented seating surface 134 (FIGS. 7 & 11) that is oblique to the axis of the plunger 72. The hollow interior of the punch 64 houses the plunger head 74 when the plunger 72 is in its fully retracted position, and the plunger head 74 carries a tab folding mechanism 136 (FIGS. 7, 8 & 11) that is normally contained within the hollow interior of protusion 130. However, the mechanism 136 does include a trip arm 138 that swings about a pin 140 that is set within the wall of the punch 64 to the rear of the cutting edge 132 along the protusion 130. Normally, the trip arm 138 depends into the hollow interior of the protusion 130 under its own weight, but it is capable of swinging rearwardly into a cutout 142 formed in the side wall of the punch 64, and when so disposed it does not obstruct the hollow interior of the protusion 130. The trip arm 138 cannot, however, swing forwardly, for the end of the cutout 142 forms a stop which prevents forward rotation.

The plunger head 74 (FIGS. 7 & 8) is slightly smaller in diameter than the circular portion of the punch cutting edge 132, and has beveled sides 144, the inclination of which corresponds to that of the beveled seating surfaces 134 in the punch 64. Indeed, when the plunger 72 is in its fully retracted position with respect to the punch 64, the beveled sides 144 are against the beveled seating surfaces 134 of the punch 64. The beveled sides 144 lead to a hub 146 at which the plunger head 74 is attached to its push rod 76. In the region of the protusion 130 for the punch 64, the plunger head 74 is cut away to provide a recess 148, in which the major portion of the folding mechanism 136 is installed.

Figure 10:
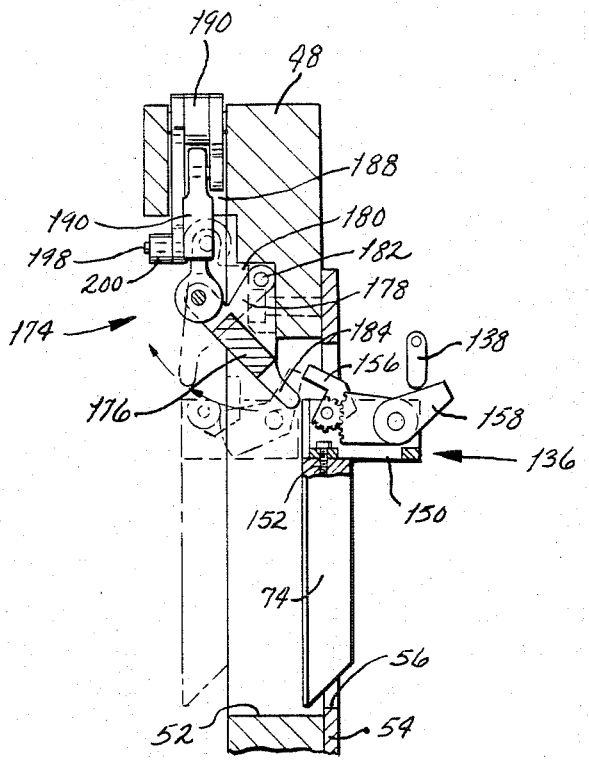
FIG. 10 is a sectional view taken along line 10—10 of FIG. 9 and showing both the holding mechanism and the folding mechanism.

Aside from the trip arm 138 on the punch 64, the folding mechanism 136 includes (FIG. 8) a mounting block 150 that fits within the recess 148 of the plunger 72 and is secured in place by a machine screw 152 (FIG. 10) which extends through it and threads into the plunger head 74. When so mounted, the block 150 extends out to and is flush with the flat front face of the plunger head 74. Indeed, the block 150 forms part of that front face. The mounting block 150 is cut away to provide cavity 154 which accommodates two folding arms 156 and an operating arm 158, all of which project out of the cavity 154 and into the hollow interior of the protusion 130.

The folding arms 156 (FIGS. 7–9), which are generally L-shaped in configuration rotate about a pivot pin 160 that extends across the cavity 156 in the block 150 and has its ends received within bearings that are located in the block 150 immediately to the rear of the flat face for the plunger head 74 and perpendicular to the radius r. The upper portions of the L-shaped arms 156 project vertically out of the cavity 154 and into the hollow interior of the punch protusion 130, at least when the arms 156 are in their fully retracted position (FIG. 11*a*). The lower portions of the two arms 156 extend generally horizontally and are attached to a gear segment 162 that is located between them and has its teeth presented generally downwardly. The pivot pin 160 likewise extends through the gear segment 162 and through a spiral return spring 164 (FIG. 8) as well, the latter being connected at its ends to the block 150 and one of the arms 156 such that the arms 156 are always urged to their retracted position (FIG. 11*a*). However, the arms 156 are free to swing forwardly to a fully extended position (FIG. 11*c*) in which they lie over the front face of the plunger head 74, or more accurately, over that portion of the front face which is on the block 150. Indeed, when the arms 156 are fully extended their inside faces lie generally parallel to and practically against the front flat face of the plunger head 74. Thus, if the tab 16 of an insert B is against the front face of the plunger head 74, as will occur when the punch 64 blanks an insert from the foil sheet s, the folding arms 156, as they move in unison from their retracted position to their extended position, will press against the coated face of the tab 16 and force the tab 16 forwardly (FIG. 11*b*). Indeed, the tab 16 will bend at its departure from the circular margin and thereby create the fold 18.

As the arms 156 move further into the fully extended position, the tab 16 folds over against the uncoated surface of the main portion 14 for the insert B.

The operating arm 158 (FIGS. 8 & 11) is somewhat V-shaped, having an upper portion that projects out of the cavity 154 to the rear of the folding arms 156 and a lower portion that lies within the cavity 154 and terminates in a gear segment 166 that meshes with the gear segment 162 of the folding arms 156. Moreover, the operating arm 158 is no wider than the gear segment 162 and its gear segment 166 fits between the two foldings arms 156. The entire operating arm 158 swings about a pivot pin 168 that extends across the cavity 154 to the rear of the pin 160, its ends being projected into bearings in the mounting block 150. Moreover, the upper portion of the operating arm 158 is located directly behind the trip arm 138 that depends from the side wall of the punch 64 into the hollow interior of the protusion 130. Thus, as the plunger 72 moves out of the punch 64 after the latter blanks an insert B from the foil sheet s (FIG. 11*b*), the operating arm 158 will come against the trip arm 138 which will not yield because it is against the end wall of the cut out 142. As a result the upper portion of the operating arm 158 depresses and rotates the arm 158 about its pin 160. The gear segment 166 on the lower portion of the arm 158, on the other hand rises, and turns the gear segment 162 for the folding arms 156. As a consequence, the folding arms 156 move forwardly against the bias of the return spring 164. Indeed, the trip arm 138 rotates the operating arm 158 just far enough to move the folding arms 156 from their fully retracted position (FIG. 11*a*) to their fully extended position (FIG. 11*c*), in which case the tab 16 on the insert B is folded over onto the uncoated surface of the main portion 14 for the insert B. The upper portion of the operating arm 158 will, after a short distance, clear the trip arm 138, whereupon the spring 164 returns the folding arms 156 to their original position, and the operating arm 158, being connected to the folding arms 156 at the gear segments 162 and 164, will likewise return to its original position (FIG. 11*d*). As the plunger 72 returns to its initial or retracted position it again contacts the trip arm 138, but the arm 138 is free to swing rearwardly into the cutout 142, which it does when the operating arm 158 comes against it (FIG. 11*f*). Once the operating arm 158 clears the trip arm 138 during the return movement, the trip arm 138 drops downwardly to its normal depending position (FIG. 11*a*).

The tab folding mechanism 136 operates in conjunction with an insert holding mechanism 174 (FIGS. 2, 7, 9 & 10) that holds the blanked insert B against the flat front faces of the plunger head 74 on each side of the tab 16 as the folding arms 156 move forwardly. This insures that the fold 18 will develop along the periphery of the main portion 14 of the insert B instead of perhaps through the main portion 14.

Figure 9:
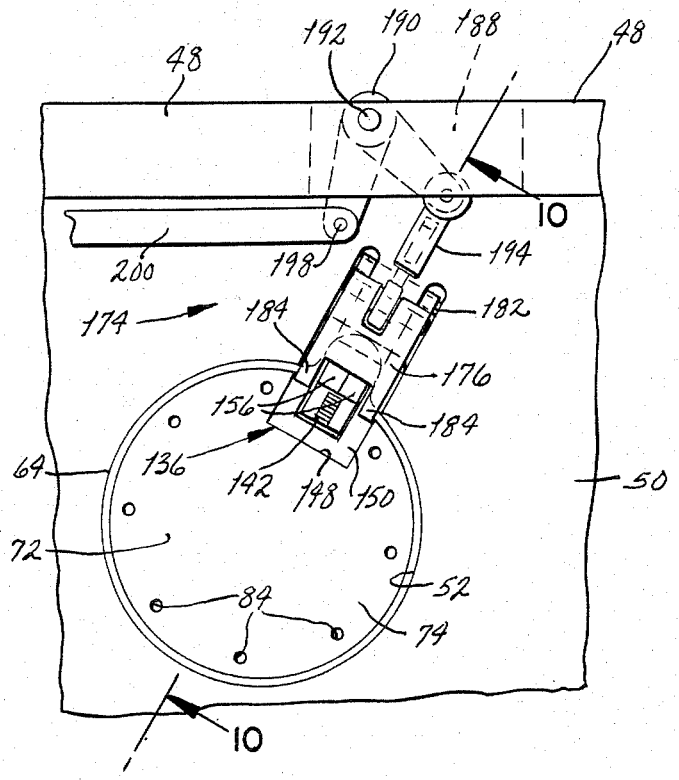
FIG. 9 is a front elevational view of one of the plungers and showing the holding mechanism that cooperates with the tab folding mechanism of that plunger.

The insert holding mechanism 174 includes three small holding elements 176 (FIGS. 7, 9 & 10) that are located within the recess 50 of the die shoe 48, there being a different holding element 176 located alongside each aperture 52 for confronting the plunger head 74 that emerges from that aperture. Each holding element 176 has a pair of rearwardly directed pivot arms 178 which straddle an offset pivot block 180 (FIGS. 7 & 10) that is bolted firmly to the front face of the die shoe 48 within its recess 50. Extended through the ends of the arms 178 on each holding element 176, as well as through the pivot block 180 for that element 176 is a pivot pin 182, that is perpendicular to the radius r that extends from the circular aperture 52 and bisects the element 176. In addition, the holding element 176 has retaining fingers 184 which project inwardly generally toward the center of the aperture 52, but terminate near the periphery of the aperture 52. The fingers 184 are spaced far enough apart to enable the folding arms 156 on the plunger 72 for the particular aperture 52 at which the element 176 is located to pass between them as the plunger head 74 emerges from the aperture 52 (FIG. 9). As this occurs the fingers 184 bear against the periphery of the insert B on each side of its tab 18 and hold that portion of the insert against the flat front face of the plunger head 74 (FIG. 11*b*). Moreover, the fingers 184 swing forwardly as the plunger head 74 continues to advance and continue to bear against the insert B (FIGS. 11*b* & 11*c*), this swinging movement being afforded by the pivot pin 182 and the arms 178. Indeed, in a typical machine A the fingers 184 will remain in contact with insert B for about 2 inches of plunger movement. To prevent the fingers 184 from damaging the insert B the lower free ends of the fingers 184 are rounded. Completing the holding element 176 are a pair of actuating arms 186 which project in the opposite direction from the retaining fingers 184 and are further always located within the confines of the recess 50.

The actuating arms 186 of the three holding elements 176 project upwardly toward cutouts 188 that extend between the recess 50 and the upper surface of the die shoe 48. Each cutout 188 houses a small bell crank 190 (FIGS. 9 & 10) that is carried by a pivot pin 192 that extends through the cutout 188 parallel to the axis of the plunger 72. The other two pivot points of the bell crank 190 are located below the pivot pin 192. At one of these pivot points the bell crank 190 is connected to the actuating arms 186 of the nearby holding element 176, the connection being through a short link 194, the length of which is adjustable. Thus, rotational movement of the bell crank 190 about the pin 192 is translated through the link 194 into rotational movement of the holding element 176 about its pin 182. To prevent the link 194 from binding or bending, the connections between it and the actuating arms 186 of the elements 176, on one hand, and the bell crank 190, on the other, are in the nature of spherical couplings.

Figure 2:
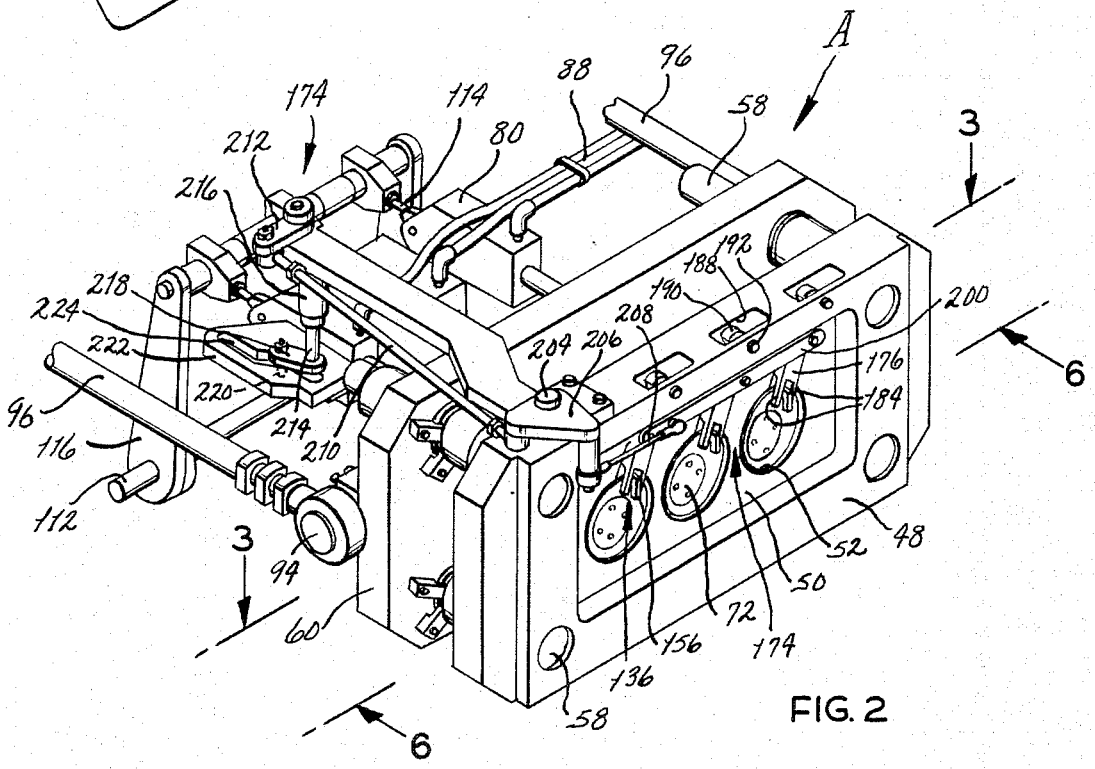
FIG. 2 is a perspective view showing the major components at the inserting station of the machine.

The third pivot point on each of the bell cranks 190 is connected by means of a pivot pin 198 (FIG. 9) to a cross bar 200 that extends horizontally through the recess 50 in the die shoe 48, generally in front of the holding elements 176 and above the circular apertures 52 (FIG. 2). The cross bar 200 likewise forms part of the holding mechanism 174 and serves to tie all of the holding elements 176 together so that they operate in unison. Thus, observing the die shoe 48 form its front face (FIG. 2), that is the face out of which the recess 50 opens, the bar 200, when moved to the right, will cause the bell cranks 190 to rotate counterclockwise. The bell cranks 190 in turn will lift the links 194 upwardly, and the links 194 will cause the holding elements 176 to pivot about their respective pins 182 such that their retaining fingers 184 move forwardly away from the apertures 52 and toward the lid holder 24. Conversely, when the bar 200 moves to the left, the fingers 184 swing inwardly toward their respective apertures 52. The bar 200 is supported entirely by the three bell cranks 190 to which it is connected by the pins 198.

In addition to the pivotal holding elements 176, the bell cranks 190, and the cross bar 200, the holding mechanism 174 also includes a bracket 202 (FIG. 2) that is attached firmly to the upper surface of the die shoe 48 and projects rearwardly from it over and beyond the punch plate 60. In the region of the die shoe 48, the bracket 202 is provided with an upstanding pin 204 about which another bell crank 206 turns. One arm of the bell crank 206 projects forwardly beyond the front face of the die shoe 48, and this arm is connected to the cross bar 200 by a connecting link 208, with the connections at each end of the link 208 being such that the link 208 can pivot with respect to the bar 200 and the bell crank 206. The other arm of the bell crank 206 projects laterally and is connected to a tie rod 210 which extends rearwardly generally along the side of the bracket 202.

At its opposite end, the tie rod 210 (FIG. 2) is connected to an operating arm 212 which projects laterally beyond the bracket 202 and is mounted upon a vertical shaft 214 that turns in a bearing 216. The bearing 216 extends downwardly from the bracket 202 and the shaft 214 projects from its lower end. The shaft 214 at its lower end is fitted with another arm 218 that is offset angularly and rearwardly with respect to the operating arm 212. The lower arm 218 has a roller follower 220 mounted upon it at its end that is remote from the vertical shaft 214. Of course, when the shaft 214 is turned by a torque applied at the lower arm 218, the tie rod 210 will shift and by reason of the bell crank 206 and the connecting link 208, the cross bar 200 at the front of the die shoe 48 will likewise move and cause the holding elements 176 to swing their retaining fingers 184 either toward or away from the apertures 52 in the die shoe 48, depending on the direction in which the lower arm 218 is turned.

Finally, the holding mechanism 174 includes a cam 222 (FIG. 2) that is mounted on the adapter 80 for the plunger 72 that is beneath the bracket 202. The cam 222 projects laterally from the adapter 80 and is located beneath the lower arm 218 or the shaft 214. It contains a groove 224 that receives the roller follower 220 on the lower arm 218 and is configured such that the rotational movement imparted to the shaft 218 will cause the resulting movements imparted to the tie rod 210, the bell crank 206, the connecting link 208, the cross bar 200, and the three bell cranks 190, to rotate the holding elements 176 such that the fingers 184 closely lead or follow the plunger head 74 as it emerges from or retracts into the apertures 52 of the die shoe 48. Indeed, in the typical machine A, the fingers 184 will stay with their respective plunger heads 74 for about 2 inches of movement for the heads 74. During this time the fingers 184 of each element 176 hold the insert B that is blanked by the punch 64 behind that block against the flat front face of the plunger head 74 on each side of the tab 16 so that the tab 16 will fold along the circular periphery of the main portion 14 for the insert B, instead of along a chord of the main portion, as the folding arm 156 moves out of the plunger head 74. In short, the cam groove 224 is configured to impart to the ends of the retaining fingers 184 for the holding elements 176, the same acceleration that the cam 104 imparts to the plunger 72, at least during the portion of the plunger stroke that the folding arm 156 emerges from the flat front face of the plunger head 74 and thereafter moves substantially to its fully extended position over that front face.

OPERATION

To prepare the machine A for operation lids C are loaded into the lid holder 24 such that their flanges 8 will be presented toward the die shoe 48 as the indexing table 22 moves the lid holder 24 to the inserting station. When the lids C are so disposed, each one aligns with a different aperture 52 in the die shoe 48. As the indexing table 22 moves, the plungers 72 and punch plate 60 are in their rearmost position and, the pressure plate 62 is spaced from the die plate 54. This spacing frees the foil sheet s so that the drive rollers 118 can advance it to place a continuous segment of the sheet immediately behind the openings 56 in the die plate 54.

The three shafts 90, 98 and 100 rotate in unison and at the same angular velocity, and as the eccentric journals 92 on the shaft 98 move out of bottom dead center, the punch plate 60 moves forwardly. The cam 104 on the shaft 98 moves the plungers 72 ahead at the same acceleration during the first 90° of rotation of the two shafts 90 and 98. During this 90° of rotation the pressure plate 62 clamps the foil sheet s tightly against the back face of the die plate 54 and the punches 64 move through the pressure plate 62 and into the openings 56 of the die plate 54, whereupon they blank the tabbed inserts B from the foil sheet s (FIG. 11*a*). The punches 64 enter their respective openings 56 in the die plate 54 slightly before the shafts 90, 98 and 100 complete 90° of rotation, and once the inserts B are blanked, the cam 104 drives the plungers 72 out of their respective punches 64 so that they continue to accelerate while the punches 64 decelerate (FIGS. 5, 11*b* & 11*c*).

As the plunger heads 74 move out of punches 64, the rearwardly presented surfaces of the inserts B will be exposed to the vacuum at the ports 84, and as a result the pressure of atmospheric air holds the inserts B against the flat forward faces of the plunger heads 74 so that the inserts B do not slide or otherwise shift on the plunger heads 74.

Shortly after each plunger head 74 emerges from its punch 64, the operating arm 158 for the folding mechanism 136 of that plunger 72 will come against the trip arm 138 in the plunger 72 and the upper portion of the operating arm 158 will be depressed as the operating arm 158 moves under the trip arm 138 (FIG. 11*b*). The operating arm 158 rotates about its pin 168 and imparts rotation to the folding arms 156, causing the latter to rotate about the pin 160, since the two arms 156 and 158 are connected at their gear segments 162 and 166. Indeed, the folding arms 156 move from their fully retracted position (FIG. 11*a*) to their fully extended position (FIG. 11*c*) and in so doing come against the coated face of the tab 16 so as to force the tab 16 forwardly.

Before the folding arms 156 reach the back face of the extended tab 16 the advancing plunger head 74 brings the insert B carried by it against the retaining fingers 184 of the holding mechanism 174 (FIG. 11*a*), and these fingers bear against the circular edge of the insert B adjacent to the locations where the margins depart from the circular configuration to form the tab 16. Indeed, the fingers 184 remain along the margin for substantially as long as the folding arms 156 move to their fully extended position (FIGS. 11*b* & 11*c*), the movement of the retaining fingers 184 being controlled by the cam 222 which is carried by one of the plungers 74. Thus, the movement of the fingers 184 is correlated of the movement of the plunger 72. Inasmuch as the insert B is held firmly against the front face of the plunger head 74 as the folding arms 156 move against the back face of the tab 16 and then forwardly to its fully extended position, the tab 16 will fold forwardly along a fold line 18 that is in effect a continuation of the circular margin for the main or disc portion 14 of the insert B.

At about the time when the folding arms 156 reach their fully extended position, the fingers 184 of the holding elements 176 swing clear of the plunger head 74 and allow the plunger head 74 to advance beyond them (FIG. 11*d*). Also, the operating arm 158 for the folding mechanism 136 clears the trip arm 138 at about this point, whereupon the spiral spring 164 returns the folding arms 156 to its retracted position and likewise returns the operating arm 158 to its elevated position.

The plunger head 74 continues to move forwardly and enters the aligned aperture 40 in the retaining plate 38 of the die holder 24 (FIGS. 5 & 11*e*). Since the circular aperture 40 is slightly smaller in diameter than the now circular insert B, the insert B is turned slightly rearwardly at its edge as the plunger head 74 then drives the insert B into the flange 8 of the lid C, whereupon the turned back edge of the insert B spreads outwardly into the groove 12 in the lid C. This represents the point of farthest advanced for the plunger head 74, and at this point the vacuum is released.

Insofar as the plungers 72 are concerned, the cam 106 now takes over and moves the plungers 72 back toward their initial positions. In particular, when the plungers 72 reach the position of the farthest advanced, the eccentric journals 92 are at top dead center. They then begin to move the punch plate 60 rearwardly. Upon completing the first 90° of movement out of top dead center, the plunger heads 74 catch up with their respective punches 72 and during the last 90° the punches 64 and plunger heads 74 return to their initial positions together. As the plunger heads 74 approach their respective punches 64, the retaining fingers 184 on the holding blocks 172 swing back over the front faces of their respective plunger heads 74 and follow those plunger heads 74 back to the apertures 52 of die shoe 48. As the plunger heads 74 enter the punches 64 the operating arms 158 of the folding mechanisms 136 will contact the trip arms 138 and swing the trip arms 138 rearwardly (FIG. 11*f*). Once the operating arms 158 clear the trip arms 138, the trip arms 138 swing downwardly under their own weight so that as to be in position to depress the operating arm 158 once the plunger head 74 again moves out of the punch 72.

The punch plate 60 and plungers 72 return to their rearmost or initial positions (FIG. 11*a*) after which the foregoing cycle is repeated.

This invention is intended to cover all changes and modifications of the example of the invention herein chosen for purposes of the disclosure which do not constitute departures from the spirit and scope of the invention.

What is claimed is:

1. A machine for inserting a flexible insert having a tab along its periphery into container lid, with the tab folded over the main portion of the insert, said machine comprising: a die having a die opening; means for holding a lid opposite the die with the portion of the lid that is to receive the insert being exposed to the die and aligned with the die opening; a punch aligned with and configured to fit into the die opening; means for moving the punch into and out of the die opening from the side of the die opposite to the one to which the lid is exposed: means for positioning a sheet of flexible material between the die and punch, whereby the punch will blank an insert from the sheet when it moves through the sheet and into the die opening; a plunger supported by the punch and having a head that is capable of moving from a position within the punch to a position beyond the punch; means for moving the plunger such that its head moves out of the punch after the punch enters the die opening and such that the head thereafter moves into a lid held by the means for holding a lid; folding means carried by the plunger for folding the tab forwardly in the direction of plunger advance and over onto the remaining portion of the insert as the plunger head moves out of the punch and toward the means for holding a lid; and holding means for holding the insert against the plunger along the periphery of the insert and on each side of the tab as the folding means folds the tab forwardly, whereby the insert will fold along a line that is in effect a continuation of the periphery for the main portion of the insert and will thereafter be deposited in the lid with the tab folded back over the remaining portion of the insert.

2. A machine for producing tabbed inserts or other closures for containers, said machine comprising: a die having a die opening; a punch aligned with and configured to fit into the die opening; means for moving the punch into and out of the die opening; means for positioning a sheet of flexible material between the die and punch, whereby the punch will blank an insert from the sheet when the punch moves through the sheet and into the die opening; a plunger supported by the punch and having a head that is capable of moving from a position within the punch to a position beyond the punch; folding means carried by the plunger for folding the tab forwardly in the direction of the plunger advance and generally over the remaining portion of the insert as the plunger head moves away from the punch, and means for holding the insert against the plunger on each side of the tab as the folding means folds the tab forwardly, whereby the insert will fold along a line that is in effect a continuation of the periphery of the main portion of the insert.

3. A machine for inserting a flexible insert having a tab on it into a container lid that is configured to receive the insert, but not with the tab extended laterally, said machine comprising: lid carrying means for supporting a lid such that an insert can be introduced into the lid with the tab folded over; a plunger capable of supporting an insert such that when the plunger is brought together with the lid carrying means, the insert is deposited in the lid; means for imparting movement to the plunger to bring it together with the lid carrying means such that an insert on the plunger will be deposited in a lid on the lid carrying means; means for folding a tab on the insert over against the remaining portion of the insert while the insert is supported on the plunger and before it is deposited in the lid, the means for folding the tab including a folding arm that is carried by the plunger and extends from the plunger to push the tab over onto the remaining portion of the insert; and holding means for holding the insert against the plunger in the region of the tab so that the tab folds at the periphery of the remaining portion of the insert.

4. A machine according to claim 3 and further comprising a punch having the configuration of the insert when its tab is directed outwardly; a die having an opening aligned with the punch and corresponding in configuration to the punch, and means for moving the punch into the die opening while a sheet of flexible material is interposed between the punch and die so that an insert is blanked from the sheet; and wherein the plunger head is carried by the punch and the means for imparting movement locates the plunger head behind the leading edge of the punch while the insert is blanked from the sheet, but causes the plunger head to move out of the punch thereafter; and wherein the folding arm folds the tab of the insert as the plunger head moves away from the punch.

5. A machine according to claim 3 wherein the holding means holds the insert against the plunger on each side of the tab immediately adjacent to the tab along the peripherial margin of the remaining portion of the insert.

6. A machine according to claim 3 wherein the plunger includes a head provided with a front surface that is presented toward the lid carrying means and the folding arm is carried by the head and when extended from the plunger projects forwardly beyond the front surface to fold the tab of the insert against the remaining portion of the insert.

7. A machine according to claim 6 wherein the means for folding the tab further includes an operating arm mounted on the plunger; wherein the folding arm and operating arm are connected together such that, when the operating arm is depressed, the folding arm moves forwardly to fold the tab; and wherein the folding means further includes trip means that lies in the path of the operating arm as the plunger advances so as to depress the operating arm and cause the folding arm to swing forwardly.

8. A machine according to claim 3 wherein the holding means comprises a holding element mounted along the path through which the plunger advances the insert such that the holding element will pivot about an axis that is located outside the path and extends generally transversely with respect to the path, the holding element having fingers which extend into the path and are along the insert on each side of its tab as the folding arm moves out of the plunger to fold the tab.

9. A machine according to claim 8 wherein the holding means includes operating means for pivoting the holding element in timed relation to the movement of the plunger such that the fingers of the holding element lie immediately ahead of the plunger but do not interfere with the plunger through a substantial portion of the path through which the plunger moves.

10. A machine according to claim 9 wherein the operating means include a cam carried by the plunger, a follower that follows the cam, and means interconnecting the follower and the holding element to translate the movement of the follower into pivotal movement for the holding element.

11. A machine for inserting a flexible insert having a tab along its periphery into a container lid, with the tab folded over the main portion of the insert, said machine comprising: a die having a die opening that matches the configuration desired for the insert; means for holding a lid opposite the die with the portion of the lid that is to receive the insert being exposed to the die and aligned with the die opening; a punch aligned with and configured to fit into the die opening, the punch having a cutting edge which extends uninterrupted along the full periphery of the punch and corresponds in configuration to the die opening, the punch in the region thereof that corresponds in configuration to the tab having a cavity that opens toward the means for holding a lid; means for moving the punch forwardly into and rearwardly out of the die opening from the side of the die opposite to the one to which the lid is exposed; means for positioning a sheet of flexible material between the die and punch, whereby the punch will blank a full insert with an outwardly directed tab from the sheet when the punch moves through the sheet and into the die opening; a plunger supported by the punch and having a head that normally occupies a major portion of the end of the punch, but does not extend out into the region of the punch that corresponds in configuration to the tab, the punch being capable of moving forwardly from a position within the punch to a position beyond the punch and further being capable of carrying a blanked insert along with it as it does, with the tab of the insert projecting outwardly beyond the periphery of the plunger; means for moving the plunger such that its head moves out of the punch after the punch enters the die opening and so that the head thereafter moves forwardly into a lid held by the means for holding a lid; and folding means for folding the tab forwardly in the direction of plunger advance and over onto the remaining portion of the insert as the plunger head moves out of the punch and toward the means for holding a lid, whereby the insert is deposited in the lid with the tab folded back over the remaining portion of the insert, the folding means including a folding arm which is carried by the plunger and which, as the plunger moves out of the punch and toward means for holding the lid, moves forwardly beyond the periphery of the plunger and against the back of the tab so as to fold the tab forwardly.

12. A machine according to claim 11 wherein the folding arm is in a cavity of the punch before the plunger moves out of the punch.

13. A machine according to claim 11 and further comprising holding means for holding the insert against the plunger along the periphery of the insert and on each side of the tab as the folding means folds the tab forwardly, whereby the insert will fold along a line that is in effect a continuation of the periphery for the main portion of the insert.

14. A machine according to claim 11 wherein the folding arm is adapted to move from a retracted position wherein it lies behind the front face of the plunger to an extended position wherein it lies along the front face of the plunger, and the folding means further comprises means for moving the folding arm from its retracted to its extended position as the plunger head moves out of the punch and toward the means for holding the lid, whereby the folding arm will contact the tab and push it forwardly to a folded condition.

15. A machine according to claim 13 wherein the holding means comprises a holding element which pivots about an axis that is fixed with respect to the die and is configured to contact the insert along its periphery on each side of its tab, without interfering with the folding arm, and means for causing the holding element to pivot about its axis such that it remains in contact with the insert while the folding arm folda the tab as the plunger advances to the means for holding the lid.

16. A machine according to claim 15 wherein the plunger has ports which open out of its forward face, and further comprising means for applying a vacuum to the ports as the plunger advances toward the means for holding a lid so as to hold a blanked insert against the front face of the plunger.

17. A machine according to claim 15 wherein the means for causing the holding element of the holding means to pivot includes a cam that is mounted on the plunger for movement with the plunger.

18. A machine according to claim 11 wherein the means for folding the tab further includes an operating arm mounted on the plunger; wherein the folding arm and operating arm are connected together such that, when the operating arm is depressed, the folding arm moves forwardly to fold the tab; and wherein the folding means further includes trip means that lies in the path of the operating arm as the plunger advances so as to depress the operating arm and cause the folding arm to swing forwardly.

* * * * *